US010856651B2

(12) United States Patent
Huang

(10) Patent No.: US 10,856,651 B2
(45) Date of Patent: Dec. 8, 2020

(54) PLACEMENT LIFTING PLATFORM

(71) Applicant: Jianming Huang, Guangdong (CN)

(72) Inventor: Jianming Huang, Guangdong (CN)

( * ) Notice: Subject to any disclaimer, the term of this patent is extended or adjusted under 35 U.S.C. 154(b) by 0 days.

(21) Appl. No.: 16/558,324

(22) Filed: Sep. 3, 2019

(65) Prior Publication Data

US 2020/0245756 A1 Aug. 6, 2020

(30) Foreign Application Priority Data

Jan. 31, 2019 (CN) ..... 2019 1 0098875

(51) Int. Cl.
*A47B 9/16* (2006.01)
*A47B 21/02* (2006.01)
*A47B 9/02* (2006.01)

(52) U.S. Cl.
CPC ..... *A47B 9/16* (2013.01); *A47B 9/02* (2013.01); *A47B 21/02* (2013.01); *A47B 2200/004* (2013.01)

(58) Field of Classification Search
CPC ..... A47B 9/16; A47B 9/02; A47B 2200/004; A47B 21/02
USPC ..... 108/144.11
See application file for complete search history.

(56) References Cited

U.S. PATENT DOCUMENTS

| | | | | |
|---|---|---|---|---|
| 5,588,377 | A * | 12/1996 | Fahmian | A47B 9/00 108/145 |
| 7,677,518 | B2 * | 3/2010 | Chouinard | A47B 21/02 108/10 |
| 9,289,058 | B2 * | 3/2016 | Flaherty | A47B 9/16 |
| 10,114,352 | B2 * | 10/2018 | Matlin | A47B 9/02 |
| 10,244,861 | B1 * | 4/2019 | Poniatowski | A47B 9/16 |
| 10,306,977 | B2 * | 6/2019 | Wong | A47B 9/16 |
| 10,517,390 | B2 * | 12/2019 | Xiang | A47B 9/16 |
| 10,542,817 | B2 * | 1/2020 | Swartz | A47B 9/16 |
| 10,555,603 | B2 * | 2/2020 | You | A47B 9/16 |
| 2017/0354245 | A1 * | 12/2017 | Martin | A47B 21/02 |
| 2019/0038015 | A1 * | 2/2019 | Huang | A47B 9/16 |
| 2019/0269237 | A1 * | 9/2019 | Zhu | A47B 9/02 |
| 2020/0015584 | A1 * | 1/2020 | Fletcher-Price | A47B 21/02 |
| 2020/0029685 | A1 * | 1/2020 | Du | A47B 21/02 |

* cited by examiner

*Primary Examiner* — Daniel J Troy
*Assistant Examiner* — Timothy M Ayres
(74) *Attorney, Agent, or Firm* — JCIP Global Inc.

(57) ABSTRACT

A placement lifting platform includes a table board, under which a bracket, scaffolds and bases are arranged. The placement lifting platform further includes a locking structure, a constant force structure and a buffer structure. By setting the constant force structure, the buffer structure and the lock structure, a constant lifting force can be provided. The adjustability function makes the platform more convenient and smooth, its buffering avoids the unnecessary collision between parts, with the special locking structure, it has better locking effect and is practical and convenient, the use effect is optimized and the applicability is improved.

7 Claims, 5 Drawing Sheets

PLACEMENT LIFTING PLATFORM

CROSS-REFERENCE TO RELATED APPLICATION

This application claims the priority benefit of China application serial no. 201910098875.2, filed on Jan. 31, 2019. The entirety of the above-mentioned patent application is hereby incorporated by reference herein and made a part of this specification.

BACKGROUND

Technical Field

The present invention relates to the furniture field, especially relates to a placement lifting platform.

Description of Related Art

Researches show that keeping a sitting position for a long term will lead to many diseases. But people have to do so while working due to the limits of the working conditions. The electric lifting and integrated desks are expensive. For this reason, placement lifting platforms which can be placed on the desk appear on the market. They are operated manually and with reasonable price. The position of the computer can be lifted according to the actual need, which enables people to alternatively work in either sitting position or standing position while working. However, there are many pain points existed in the current placement lifting platform.

Firstly, spring is often used in the lifting system of common lifting platform to provide elastic force, the elastic force provided by spring in the process of expansion is a variable force, that will make it do not go smoothly during use, the objects placed on the desk are changed, so the problem of unsuitability will often arise when the weight of the desk changes during the lifting process.

Secondly, parts often collide with each other because of negligence at the end of the descending process in the common lifting platform, especially when there are too many heavy objects on the lifting platform.

Thirdly, most of the lock structures of the common lifting platform adopt the way of installing clamp teeth under the table board to cooperate with the bolt, which is high in cost and difficult to use.

SUMMARY

In view of the shortcomings of the existing technology, the present invention discloses a placement lifting platform, of which a constant lifting force can be provided with adjustability function, makes the platform more convenient and smooth, its buffering avoids the unnecessary collision between parts, with the special lock structure, it has better locking effect and is practical and convenient, its specific technical characteristics are as follows.

A placement lifting platform includes a table board, a movable device, a bottom connecting block, a constant force structure, a buffer structure, and a locking structure. A bracket is installed under the table board, and one or more X-type scaffolds are arranged below the bracket. Each of the X-type scaffolds includes first supporting feet and second supporting feet. A base is provided at a bottom of the scaffold, an upper end of each of the first supporting feet is rotatably connected with the bracket, a lower end of each of the first supporting feet is slidably connected with the base, an upper end of each of the second supporting feet is slidably connected with the bracket, and a lower end of each of the second supporting feet is rotatably connected with the base. The movable device is arranged on the bracket and includes a sliding groove which is arranged on the bracket. A matching sliding rail seat is installed in the sliding groove, the sliding rail seat is fixed in the sliding groove, a sliding rail is arranged in the sliding rail seat, the sliding rail is slidably connected with the sliding rail seat, a connecting plate is installed on the sliding rail, one end of the bracket is connected with the upper end of each of the first supporting feet, the upper end of each of the second supporting feet is arranged on the connecting plate. The movable device includes two corresponding sets. A first spring connecting pipe is provided between the two corresponding connecting plates, a position of the first spring connecting pipe is matched with the upper end of each of the second supporting feet. The bracket is provided with a second spring connecting pipe, two ends of the second spring connecting pipe are connected with the upper end of each of the first supporting feet. A lifting spring is provided between the first spring connecting pipe and the second spring connecting pipe. A bottom connecting block is arranged between the first supporting feet and connected with the lower end of each of the first supporting feet. The constant force structure is installed on the base and an adjustable constant force is provided thereon. The buffer structure is installed on the base and a buffering is provided thereon. The locking structure is arranged under the table board and is adapted for locking a height of the lifting platform. The constant force structure includes a constant force spring, an adjusting structure and an adjusting knob. The constant force spring provides an elastic force together with the lifting force from the lifting platform itself to produce a constant force. The adjusting structure includes a first adjusting block and a second adjusting block arranged on two sides of the constant force spring. The adjusting screw runs through both ends of the constant force spring, the adjusting screw runs through the first adjusting block and the constant force spring and is installed on the second adjusting block, and the adjusting screw is screwedly connected with the first adjusting block. The adjusting knob is installed on one end of the adjusting screw which is closed to the first adjusting block. The constant force spring of the constant force structure is matched with the lifting spring. The second adjusting block is arranged on the bottom connecting block, the other end of the adjusting screw is connected with the second adjusting block, the end of the adjusting screw closed to the first adjusting block passes through the first adjusting block and the base, and the end of the adjusting screw is provided with the adjusting knob. The buffer structure includes a buffer device and a buffer block. The buffer device includes a buffer spring, one or more kinds of buffer airbags, and the quantity of the buffer device is one or more. The buffer block has a position matched with the buffer device, and the buffer block and the buffer device are separably connected to each other. One end of the buffer device is connected with the base, the other end of the buffer device is provided with a buffer block, the buffer block is arranged on the bottom connecting block, and the buffer structure and the constant force structure are symmetrically arranged. The locking structure includes a clamp plate, a clamp switch, a buckle structure, and a reset structure. The clamp plate is provided with a number of concave positioning teeth. The clamp switch is arranged on one side of the clamp plate and includes a handle shaft, and an end of the handle shaft is provided with a handle. The buckle structure includes one or more buckle seats located in a middle of the handle shaft, the handle shaft runs through the buckle seats, and the handle shaft is rotatably connected with the buckle seats. A first buckle holder is arranged in the buckle seats and is installed on the handle shaft, the first buckle holder rotates synchronously with the handle shaft, a second buckle holder is fixed on an outer side of the first buckle holder, and a top of the second buckle holder is provided with an elbow. A position of the elbow is matched with the clamp plate, and a size of the elbow is matched with a spacing of the concave positioning teeth. The reset structure provides a restoring force to the buckle structure. The clamp switch, the buckle structure and the reset structure of the locking structure are installed on the bracket, the clamp plate is fixedly connected with the connecting plate, and the clamp plate slides synchronously with the upper end of each of the second supporting feet.

Furthermore, the clamp switch, the buckle structure and the reset structure constitute a set of independent clamp structure, two separate sets of clamp structures are arranged on the clamp plate, the two sets of clamp structures are arranged on one side of the clamp plate respectively. One end (inward end) of the handle shaft is connected with the buckle structure, and a handle is arranged on the other end (outward end) of the handle shaft away from the buckle structure.

Furthermore, the reset structure includes a pressure pad, two ends of the pressure pad are respectively provided with pressure pad screws, the pressure pad screws pass through the pressure pad, a reset spring is arranged between a head of each of the pressure pad screws and the pressure pad, and the pressure pad is arranged on a side of the second buckle holder which away from the clamp plate.

Furthermore, the reset structure includes a torsion spring which is arranged in the buckle seat, and two ends of the torsion spring are respectively connected with the buckle seat and the outer side of the first buckle holder.

Furthermore, the buffer device includes a first buffer spring and a second buffer spring, a length of the first buffer spring is the same as that of the second buffer spring, the second buffer spring and the first buffer spring are placed in parallel, and the first buffer spring and the second buffer spring are respectively connected with the buffer block at the bottom of the scaffold.

Furthermore, the buffer device includes a first buffer spring and a second buffer spring, a length of the second buffer spring is half of that of the first buffer spring, the second buffer spring and the first buffer spring are placed in parallel, the second buffer spring is tapered, and the second buffer spring is placed in the first buffer spring or on one side of it.

Furthermore, a side of the bracket is provided with a handle shaft support, the handle shaft is installed on the handle shaft support, an end of the handle shaft support away from the bracket is provided with a first connecting surface which extends under the table board, an angle between the first connecting surface and the table board is 25-50 degrees, an end of the first connecting surface away from the handle shaft support is provided with a keyboard tray which is set parallel to the table board, a width of the keyboard tray is 15-25 cm.

Furthermore, the base is provided with a base groove, a glidepath is arranged in the base groove, the sides of a bottom connecting seat are slidably connected with the glidepath, a block is arranged on the base, and a height of the block is matched with a width of the scaffold, bottom feet are arranged at both ends of the base.

The advantage effect of the present invention is as follows. By setting the constant force structure, the buffer structure and the locking structure, a constant lifting force can be provided with the adjustability function, makes the platform more convenient and smooth, its buffering avoids the unnecessary collision between parts, with the special locking structure, it has better locking effect and is practical and convenient, the use effect is optimized and the applicability is improved.

To make the aforementioned more comprehensible, several embodiments accompanied with drawings are described in detail as follows.

BRIEF DESCRIPTION OF THE DRAWINGS

The accompanying drawings are included to provide a further understanding of the disclosure, and are incorporated in and constitute a part of this specification. The drawings illustrate exemplary embodiments of the disclosure and, together with the description, serve to explain the principles of the disclosure.

DESCRIPTION OF THE EMBODIMENTS

To further understand the technology solutions, specific objectives and functions of the present invention, the present invention will be described in detail by combination of the figures and embodiments.

Figure 1:
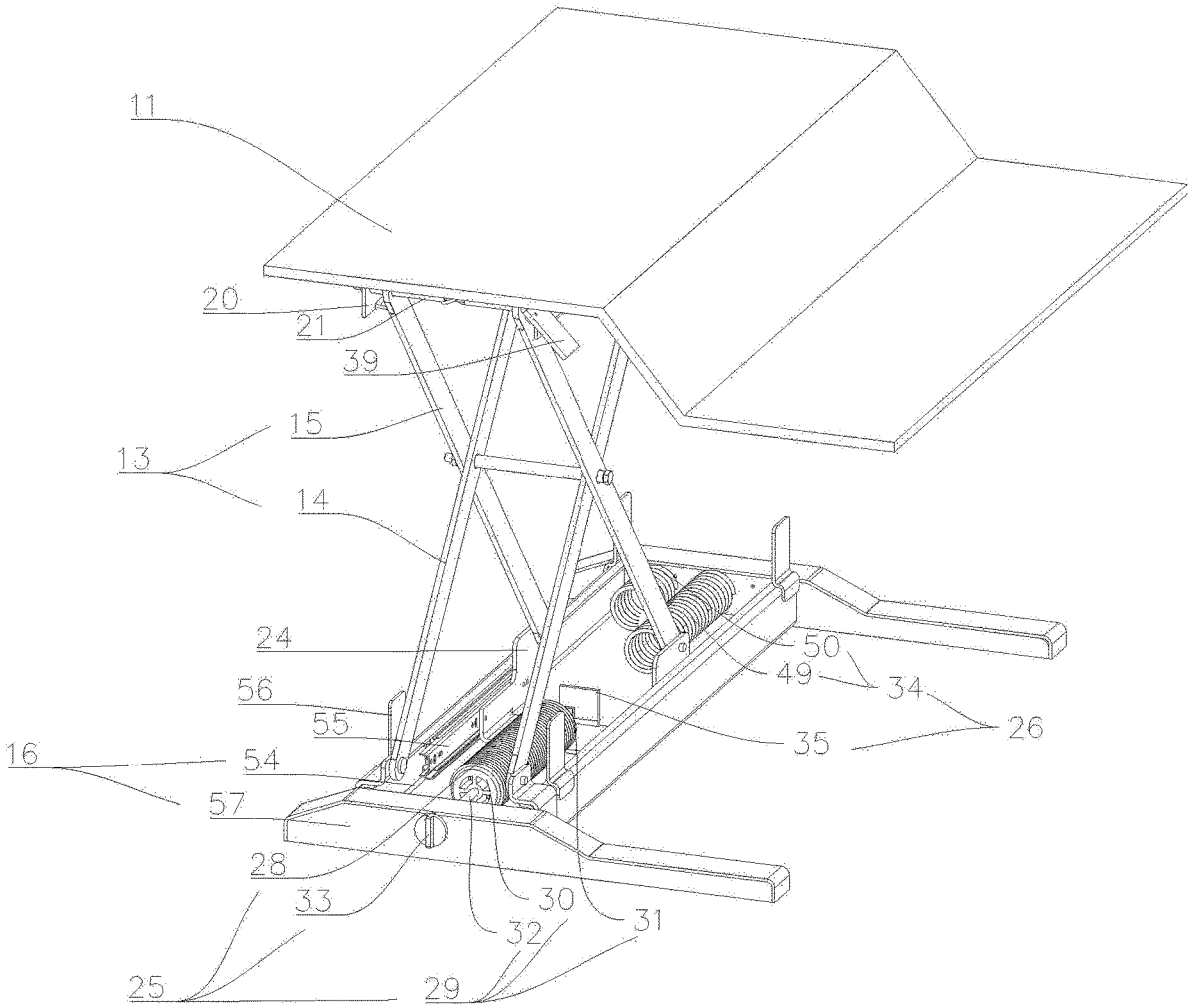
FIG. 1 is a structural diagram of a placement lifting platform of the present invention.
Figure 2:
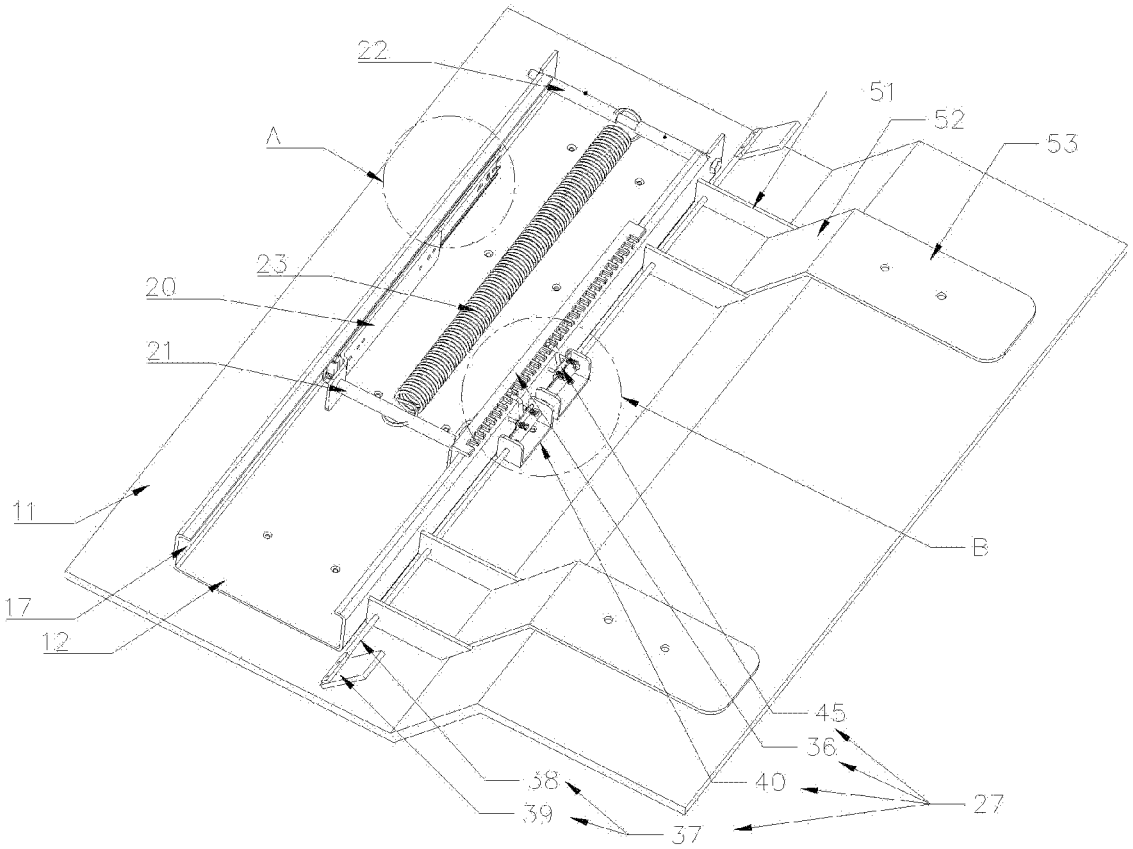
FIG. 2 is a structural diagram of an upper part of the placement lifting platform of the present invention.
Figure 3:
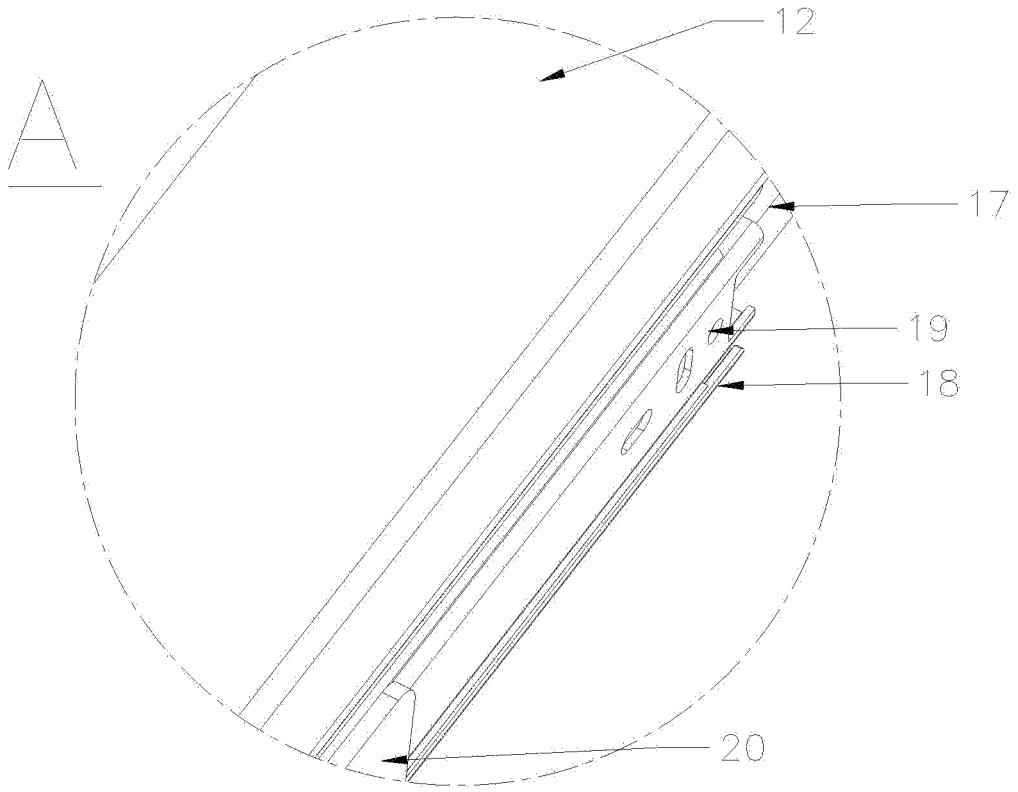
FIG. 3 is an enlarged diagram of part A of FIG. 2.
Figure 4:
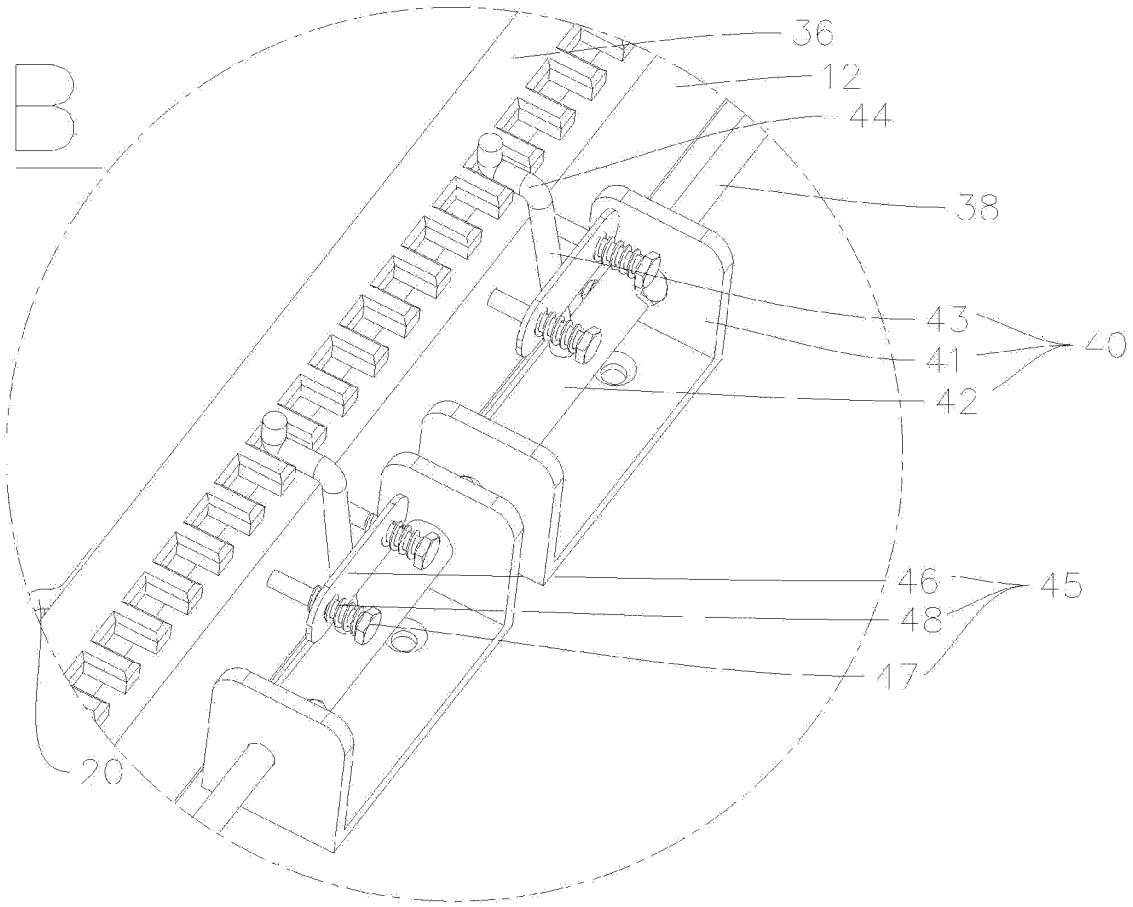
FIG. 4 is an enlarged diagram of part B of FIG. 2.
Figure 5:
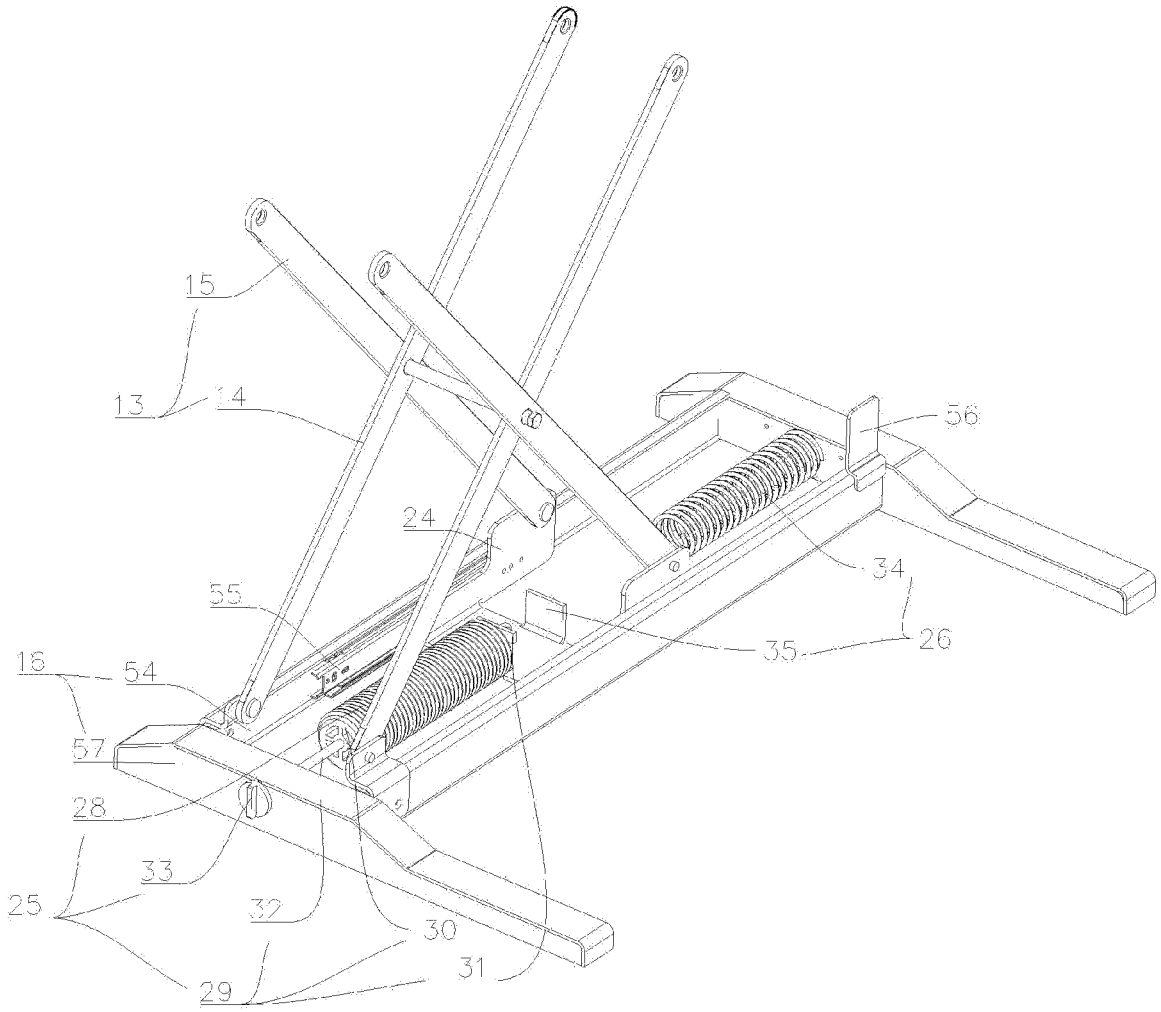
FIG. 5 is a structural diagram of a lower part of the placement lifting platform of the present invention.

Please refer to the attached drawings, this embodiment is a placement lifting platform, which can be placed on a workbench for placing computers and so on. The placement lifting platform is used to change a height of a desktop so as to realize the alternation of standing and sitting at work. The placement lifting platform includes a desk board 11 which is Z-shaped, an upper surface of the desk board 11 can be placed with display screens and articles, a lower surface of the desk board 11 can be placed with keyboard (refer to FIG. 1), the bracket 12 is installed under the desk board 11, there is a pair of (or only a single one is used) X-type scaffolds 13 under the bracket 12, each of the X-type scaffold 13 includes first supporting feet 14 and second supporting feet 15, usually a middle of the corresponding first supporting feet 14 and the second supporting feet 15 are hinged, the hinged parts are connected, the base 16 is arranged under the scaffolds 13, an upper end of the first supporting feet 14 is rotatably connected with the bracket 12, a lower end of the first supporting feet 14 is sliding connected with the base 16, an upper end of the second supporting feet 15 is slidably connected with the bracket 12, and a lower end of the second supporting feet 15 is rotatably connected with the base 16.

A movable device is arranged on the bracket 12 and includes a sliding groove 17 which is arranged on the bracket 12, a matching sliding rail seat 18 is installed in the sliding groove 17, the sliding rail seat 18 is fixed in the sliding groove 17, a sliding rail 19 is arranged in the sliding rail seat 18, they are slidably connected, a connecting plate 20 is installed on the sliding rail 19, one end of the bracket 12 is connected with the upper end of the supporting feet 14, the upper end of the second supporting feet 15 is arranged on the connecting plate 20, so that the second supporting feet 15 and the slide rail seat 18 can slide relatively.

The movable device is preferred to be a pair, the two corresponding connecting plates 20 are provided with the first spring connecting pipe 21 as well, a position of the first spring connecting pipe 21 is matched with the upper end of the second supporting feet 15. Specifically, the upper end of the second supporting feet 15 is installed on the connecting plate 20 at the two ends of the first spring connecting pipe 21 by a nut, the second spring connecting pipe 22 is installed on the bracket 12, the upper end of the first supporting feet 14 is connected with the two ends of the connecting pipe 22, the lifting spring 23 is arranged between the first spring connecting pipe 21 and the second spring connecting pipe 22 to provide a lifting force during the lifting process.

A bottom connecting block 24 is arranged between the first supporting feet 14 and connected with the lower end of each of the first supporting feet 14.

A constant force structure 25 is installed on the base 16 and provides an adjustable constant force.

A buffer structure 26 is also installed on the base 16 and provides a buffering.

A locking structure 27 is arranged under the table board 11 and is adapted for locking a height of the lifting platform.

The constant force structure 25 includes a constant force spring 28, an adjusting structure 29 and an adjusting knob 33. The constant force spring 28 provides an elastic force together with the lifting force from the lifting platform itself to produce a constant force. The adjusting structure 29 includes a first adjusting block 30 and a second adjusting block 31 arranged on both sides of the constant force spring 28. An adjusting screw 32 runs through both ends of the constant force spring 28, the adjusting screw 32 runs through the first adjusting block 30 and the constant force spring 28, and is installed on the second adjusting block 31, the adjusting screw 32 is screwed connected with the first adjusting block 30. The adjusting knob 33 is installed at the end of the adjusting screw 32 which is closed to the first adjusting block 30. The constant force spring 28 of the constant force structure 25 is matched with the lifting spring 23, specifically, both of them have the same coefficient of elasticity, so that at the time of pulling the lifting spring 23 to produce a pulling force, compressing the constant force spring 28 to provide a pressure to offset the force from the lifting spring 23 during the lifting process, and then a constant force is produced, the second adjusting block 31 is arranged on the bottom connecting block 24, the other end of the adjusting screw 32 is connected with the second adjusting block 31, the end of the adjusting screw 32 passes through the first adjusting block 30 and the base 16, and the end of the adjusting screw 32 which is closed to the first adjusting block 30 is provided with a adjusting knob 33, turning the adjusting knob 33 to adjust the position of the first adjusting block 30 so as to change the length of the constant force spring 28, ultimately various constant forces are provided, of course, the adjusting structure 29 can be placed on the lifting spring 23, the length of the lifting spring 23 is adjusted to provide a constant force, or both of them use the adjusting structure 29.

The buffer structure 26 includes a buffer device 34 and a buffer block 35. The buffer device 34 includes but is not limited to, a buffer springs, one or more kinds of buffer airbags, the quantity of the buffer device is one or more. The buffer block 35, its position is matched with the buffer device 34, the buffer block 35 and the buffer device 34 are separably connected to each other. That is, the buffer block 35 may be separated from the buffer device 34.

One end of the buffer device 34 is fixed on the base 16, the bottom connecting block 24 is provided with a buffer block 35, one end of the buffer device 34 is connected with the inner side of the base 16, the other end of the buffer device 34 is matched with the buffer block 35, the buffer structure 26 is symmetrically arranged with the constant force structure 25.

The locking structure 27 includes a clamp plate 36, a clamp switch 37, a buckle structure 40 and a reset structure 45. The clamp plate 36, on which a number of concave positioning teeth are provided. The clamp switch 37 is arranged on one side of the clamp plate 36 and includes a handle shaft 38. The end of the handle shaft 38 is provided with a handle 39. The buckle structure 40 includes one or more buckle seats 41 located in the middle of the handle shaft 38, the handle shaft 38 can be passed through the buckle seats 41, the handle shaft 38 is rotatable connected with the buckle seats 41, the first buckle holder 42 is arranged in the buckle seats 41 and is installed on the handle shaft 38. Specifically the first buckle holder 42 can be sheathed on the handle shaft 38, the first buckle holder 42 rotates synchronously with the handle shaft 38, a second buckle holder 43 is fixed on an outer side of the first buckle holder 42, a top of the second buckle holder 43 is provided with an elbow 44, a position of the elbow 44 is matched with the clamp plate 36, a size of the elbow 44 is matched with a spacing of the concave positioning teeth. The reset structure 45 provides a restoring force to the buckle structure 40. The clamp switch 37, the buckle structure 40 and the reset structure 45 in the lock structure 27 are installed on the bracket 12, the clamp plate 36 is fixed and connected with the connecting plate 20, and the clamp plate 36 slides synchronously with the upper end of the second supporting feet 15.

In the present embodiment, the clamp switch 37, the buckle structure 40 and the reset structure 45 constitute a set of independent clamp structure, two separate sets of clamp structures are arranged on the clamp plate 36, the two sets of clamp structures are arranged on one side of the clamp plate 36 respectively.

One end (inward end) of the handle shaft 38 is connected with the buckle structure 40, and a handle 39 is arranged on the other end (outward end) of the handle shaft 38 away from the buckle structure 40.

The reset structure 45 of the present embodiment includes a pressure pad 46, two ends of the pressure pad 46 are respectively provided with a pressure pad screw 47, the pressure pad screw 47 passes through the pressure pad 46, a reset spring 48 is arranged between a head of each of the pressure pad screws 47 and the pressure pad 46, and the pressure pad 46 is arranged on a side of the second buckle holder 43 away from the clamp plate 36.

The reset structure 45 in another embodiment includes a torsion spring which is arranged in the buckle seat 41, and two ends of the torsion spring are respectively connected with the buckle seat and the outer side of the first buckle holder 42.

Pressing the handle 39 to drive the handle shaft 38 to rotate, so that the elbow 44 and the clamp plate 36 are separated, by this way the height of the lifting platform can be adjusted, after being released, in the function of the reset structure 45, the elbow 44 is reset, so that the elbow 44 is re-clamped on the clamp plate 36.

To improve the performance of the buffer device 34, the buffer device 34 includes a first buffer spring 49 and a second buffer spring 50, a length of the second buffer spring 50 is half of that of the first buffer spring 49, the second buffer spring 50 is placed parallel to the first buffer spring 49, the second buffer spring 50 is tapered, and the second buffer spring 50 is placed on one side of the first buffer spring 49 to provide the second buffering.

In the other embodiment, a length of the first buffer spring 49 is as same as that of the second buffer spring 50, the second buffer spring 50 is placed parallel to the first buffer spring 49, and the first buffer spring 49 and the second buffer spring 50 are connected with the buffer block 35 on the bottom of the scaffold 13.

In addition, at the side of the bracket 12 of this embodiment is provided with a handle shaft support 51, the handle shaft 38 is installed on the handle shaft support 51, the end of the handle shaft support 51 away from the bracket 12 is provided with the first connecting surface 52 which extends under the table board 11. An angle between the first connecting surface 52 and the table board 11 is 30 degrees. The end of the first connecting surface 52 away from the handle shaft support 51 is provided with a keyboard tray 53 which is set parallel to the table board 11. A width of the keyboard tray 53 is 20 cm. The desktop is placed on the first connecting surface 52 and the keyboard tray 53 as well, which makes the desktop contain a slanted plane (above the first connecting surface 52), this plane can be placed with mobile phones, etc., it is more convenient to use, moreover, the handle 39 is set behind the slanted plane, which is easily to be found and used.

In the other embodiment, the locking structure 27 is set in the bracket 12 which can increase the width of the bracket 12, and shorten or cancel the handle shaft support 51. A cover plate is also provided to hide the other structures of locking structure 27 and the bracket 12. The second buckle holder 43 can be sheet to improve the density of the clamp teeth and fluency during the lifting process.

The base 16 of the present embodiment is provided with the base groove 54, the glidepath 55 is arranged in the base groove 54, two sides of the base and the glidepath 55 are slidably connected, a block 56 is arranged on the base 16, a height of the block 56 is matched with the width of the scaffold 13, the bottom feet 57 is arranged at both ends of the base 16 to improve the stability. The outlines of the bracket 12, the first connecting surface 52 and the keyboard tray 53 should be matched with the bottom feet 57.

The above embodiments are only one kind of implementation of the present invention which are specific and in detail, but are not to be construed as a limitation to the present of invention. It should be noted that for the person skilled in the art, several kinds of deformation and improvement could be made within the conception of the present invention, all of which are the protection scope of the present invention. Therefore, the protection scope of the present patent shall be subjected to the claims.

What is claimed is:

1. A placement lifting platform, comprising:

a table board, wherein a bracket is installed under the table board, one or more X-type scaffolds are arranged below the bracket, each of the X-type scaffold includes first supporting feet and second supporting feet, a base is provided at a bottom of the scaffold, an upper end of each of the first supporting feet is rotatably connected with the bracket, a lower end of each of the first supporting feet is slidably connected with the base, an upper end of each of the second supporting feet is slidably connected with the bracket, a lower end of each of the second supporting feet is rotatably connected with the base;

a movable device, arranged on the bracket and including a sliding groove which is arranged on the bracket, wherein a matching sliding rail seat is installed in the sliding groove, the sliding rail seat is fixed in the sliding groove, a sliding rail is arranged in the sliding rail seat, the sliding rail is slidably connected with the sliding rail seat, a connecting plate is installed on the sliding rail, one end of the bracket is connected with the upper end of each of the first supporting feet, the upper end of each of the second supporting feet is arranged on the connecting plate; the movable device includes two corresponding sets, a first spring connecting pipe is provided between the two corresponding connecting plates, a position of the first spring connecting pipe is matched with the upper end of each of the second supporting feet, the bracket is provided with a second spring connecting pipe, two ends of the second spring connecting pipe are connected with the upper end of each of the first supporting feet, a lifting spring is provided between the first spring connecting pipe and the second spring connecting pipe;

a bottom connecting block, arranged between the first supporting feet and connected with the lower end of each of the first supporting feet;

a constant force structure, installed on the base and an adjustable constant force is provided thereon;

a buffer structure, installed on the base and a buffering is provided thereon; and a locking structure, arranged under the table board and is adapted for locking a height of the lifting platform;

wherein the constant force structure includes:

a constant force spring, which provides an elastic force together with a lifting force from the lifting platform itself to produce a constant force;

an adjusting structure, which includes a first adjusting block and a second adjusting block arranged on two sides of the constant force spring, wherein an adjusting screw runs through both ends of the constant force spring, the adjusting screw runs through the first adjusting block and the constant force spring and is installed on the second adjusting block, and the adjusting screw is connected with a thread of the first adjusting block; and an adjusting knob, installed on one end of the adjusting screw which is closed to the first adjusting block; wherein the constant force spring of the constant force structure is matched with the lifting spring, the second adjusting block is arranged on the bottom connecting block, the other end of the adjusting screw is connected with the second adjusting block, the end of the adjusting screw closed to the first adjusting block passes through the first adjusting block and the base, and the end of the adjusting screw is provided with the adjusting knob;

wherein the buffer structure includes:

a buffer device, which includes a buffer spring, one or more kinds of buffer airbags, the quantity of the buffer device is one or more; and a buffer block, of which a position is matched with the buffer device, wherein the buffer block and the buffer device are separably connected to each other; one end of the buffer device is connected with the base, the other end of the buffer device is provided with the buffer block, the buffer block is arranged on the bottom connecting block, and the buffer structure and the constant force structure are symmetrically arranged;

wherein the locking structure includes:

a clamp plate, which is provided with a number of concave positioning teeth;

a clamp switch, arranged on one side of the clamp plate and including a handle shaft, wherein an end of the handle shaft is provided with a handle;

a buckle structure, which includes one or more buckle seats located in a middle of the handle shaft, wherein the handle shaft is rotatably connected with the buckle seats, a first buckle holder is arranged in the buckle seats and is installed on the handle shaft, the first buckle holder rotates synchronously with the handle shaft, a second buckle holder is fixed on an outer side of the first buckle holder, a top of the second buckle holder is provided with an elbow, a position of the elbow is matched with the clamp plate, a size of the elbow is matched with a spacing of the concave positioning teeth; and a reset structure, which provides a restoring force to the buckle structure;

wherein the reset structure includes a pressure pad, two ends of the pressure pad are respectively provided with pressure pad screws, the pressure pad screws pass through the pressure pad, a reset spring is arranged between a head of each of the pressure pad screws and the pressure pad, and the pressure pad is arranged on a side of the second buckle holder away from the clamp plate; wherein the clamp switch, the buckle structure and the reset structure of the lock structure are installed on the bracket, the clamp plate is fixedly connected with the connecting plate, the clamp plate slides synchronously with the upper end of each of the second supporting feet.

2. The placement lifting platform of claim 1, wherein the clamp switch, the buckle structure and the reset structure constitute a set of independent clamp structure, two separate sets of clamp structures are arranged on the clamp plate, the two sets of clamp structures are arranged on one side of the clamp plate respectively;

one end of the handle shaft is connected with the buckle structure, and a handle is arranged on the other end of the handle shaft away from the buckle structure.

3. The placement lifting platform of claim 1, wherein the reset structure includes a torsion spring which is arranged in the buckle seat, and two ends of the torsion spring are respectively connected with the buckle seat and the outer side of the first buckle holder.

4. The placement lifting platform of claim 1, wherein the buffer device includes a first buffer spring and a second buffer spring, a length of the first buffer spring is the same as that of the second buffer spring, the second buffer spring and the first buffer spring are placed in parallel, and the first buffer spring and the second buffer spring are respectively connected with the buffer block at the bottom of the scaffold.

5. The placement lifting platform of claim 1, wherein the buffer device includes a first buffer spring and a second buffer spring, a length of the second buffer spring is half of that of the first buffer spring, the second buffer spring and the first buffer spring are placed in parallel, the second buffer spring is tapered, and the second buffer spring is placed in the first buffer spring or on one side of it.

6. The placement lifting platform of claim 1, wherein a side of the bracket is provided with a handle shaft support, the handle shaft is installed on the handle shaft support, an end of the handle shaft support away from the bracket is provided with a first connecting surface which extends under the table board, an angle between the first connecting surface and the table board is 25-50 degrees, an end of the first connecting surface away from the handle shaft support is provided with a keyboard tray which is set parallel to the table board, a width of the keyboard tray is 15-25 cm.

7. The placement lifting platform of claim 1, wherein the base is provided with a base groove, a glidepath is arranged in the base groove, two sides of a bottom connecting seat are slidably connected with the glidepath, a block is arranged on the base, and a height of the block is matched with a width of the scaffold, bottom feet are arranged at both ends of the base.

* * * * *